US005511691A

United States Patent [19]

West, Jr.

[11] Patent Number: 5,511,691

[45] Date of Patent: Apr. 30, 1996

[54] PLASTIC GROCERY BAG DISPENSER AND STORAGE CONTAINER

[76] Inventor: Stanley M. West, Jr., Rte. 4 Box 6357-2, Crawfordville, Fla. 32327

[21] Appl. No.: 280,346

[22] Filed: Jul. 25, 1994

[51] Int. Cl.[6] ..... A47F 1/04

[52] U.S. Cl. ..... 221/311; 221/45

[58] Field of Search ..... 221/311, 372 R, 221/61, 63, 45

[56] References Cited

U.S. PATENT DOCUMENTS 4,574,981 3/1986 Jewett ..... 221/311

5,042,687 8/1991 McKinley ..... 221/311

*Primary Examiner*—Kenneth Noland

*Attorney, Agent, or Firm*—Carnes, Cona, and Dixon

[57] ABSTRACT

The present invention provides for a container that will store a plurality of used plastic grocery bags. The container of the present invention consists of a hollow cylindrical sleeve having a top portion and a bottom portion. The top portion further includes an open end while the bottom portion includes a bottom panel. The bottom panel is integral with the sleeve. A slot is located at the bottom portion of the sleeve. This slot permits for bags to be extracted individually and efficiently.

5 Claims, 2 Drawing Sheets

PLASTIC GROCERY BAG DISPENSER AND STORAGE CONTAINER

BACKGROUND OF THE INVENTION

1. Field of the Invention

The present invention relates to a storage and dispensing container for used plastic grocery bags and more particularly to a storage and dispensing container that is free standing and that will efficiently release one bag at a time.

2. Description of the Related Art

Plastic bags are generally used by supermarkets for packing groceries. After the groceries are unpacked, many thrifty individuals wish to save them for reuse. Since the plastic bag has an expanding nature, even a few bags placed in a drawer will tend to fill it. Some individuals store several bags inside another plastic bag, which is then hung on a hook or elsewhere. These types of arrangements will render the plastic bags somewhat inconvenient to store and retrieve. Further, these stored bags frequently are untidy and unsightly.

It has long been recognized that there is a need to provide for a container that will store and dispense used plastic grocery bags. Such a container is disclosed in, for example, U.S. Pat. No. 5,042,687 issued to McKinley on Aug. 27, 1991. The container disclosed in the McKinley patent consists of curved and flat side walls.

A problem with McKinley is that although the flat side of the wall provides an easy means of hanging the container, the combination of the flat and curved portions does not permit an easy extraction of the stored grocery bags. None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, and by employing only readily available material.

SUMMARY OF THE INVENTION

The storage container of the present invention provides a means of storing and dispensing used plastic grocery bags. The unique design of this container enables several plastic bags to be stored while providing the dispensing of only one bag at a time.

The storage container of the present invention consists of an encompassing side wall or sleeve. The side wall has an upper portion and a lower portion. Located at the top of the side wall is an open end while attached to the bottom of the side wall is a bottom panel. An opening or slot is provided in the encompassing side wall. The open end of the sleeve receives the plastic bags while the opening or slot within the sleeve permits for the extraction of the plastic bags. The container of the present invention is fabricated from a durable and rigid material, such as PVC (polyvinyl chloride).

Accordingly, it is the object of the present invention to provide a means for compacting the plastic bags into a small space.

Another object of the present invention is to provide a container that is free standing or can optionally be attached to a surface, such as the interior of a door.

Still another object of the present invention is to provide a container that will enable the extraction of one bag at a time.

Other objects, features and advantages of the present invention will become apparent to those skilled in the art from the following detailed description. It should be understood, however, that the detailed description and specific examples while indicating preferred embodiments of the present invention, are given by way of illustration and not limitation. Many changes and modifications within the scope of the invention may be made without departing from the spirit thereof, and the invention includes all such modifications.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
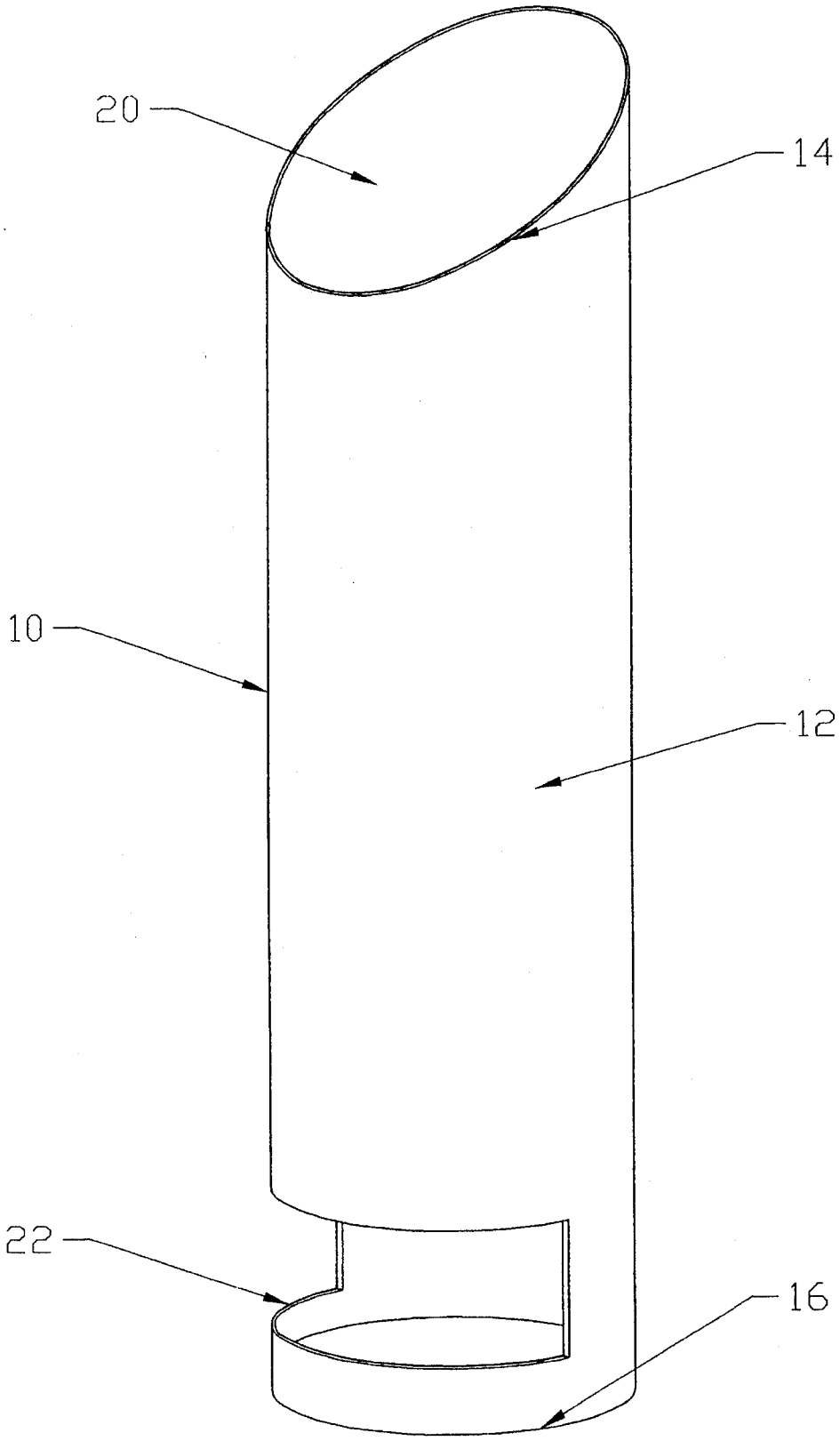
FIG. 1 is a perspective view of the first embodiment of the present invention.

An assembled storage container is illustrated in FIG. 1. As seen, the storage container 10 includes an encompassing side wall or sleeve 12. This encompassing side wall or sleeve has a circular cross-section and must have a diameter of 3 inches. The encompassing side wall includes a top portion 14 and a bottom portion 16. The top portion of the sleeve is open to provide for an open top 20. This open top 20 will permit for used plastic grocery bags to be inserted into the storage container 10. Attached to the bottom portion of the sleeve is a bottom panel (illustrated, but not labeled).

The encompassing side wall and the bottom panel of the insulator can be fabricated from a variety of materials. It is noted that PVC (polyvinyl chloride) has been utilized to produce excellent results. Other material of a varying degree of hardness may also be utilized, such as metal and polymers.

In and near the bottom portion of the sleeve, and located in the front of the sleeve, is a slot 22. This slot 22 must be of a sufficient width and length dimension in order to permit for a bag to be extracted. To enable for only one bag at a time to be dispensed, the slot must be approximately 1½ inches in thickness (preferably 1¼ to 1½ inches). The slot must also have a length that is ½ the diameter of the sleeve. A width or length that is too small will not permit for the bags to be dispensed easily or effectively. A width or length that is too large will not permit bags to be dispense singularly, but rather several will be extracted. This particular width and length will provide for one bag to be completely exposed while a second bag will be partially exposed.

Though not separately illustrated, the top portion of the encompassing side wall can include a lid. The lid is adapted to be removably secured to the encompassing side wall.

The bottom panel can rest on a surface (such as a counter top) so that the container can be a free standing article. The container can also include an attachment means to permit for the encompassing wall to be attached to a surface (i.e. the inside of a cabinet door). In order to do so, located in the top portion and the back of the encompassing side wall is the attaching means. This attachment means can include a plurality of conventional hooks, nails, etc. An aperture is illustrated in the second figure in order to enable a nail to be located therein. A second attachment means (not illustrated) may be located on the back and bottom portion of the encompassing side wall.

Figure 2:
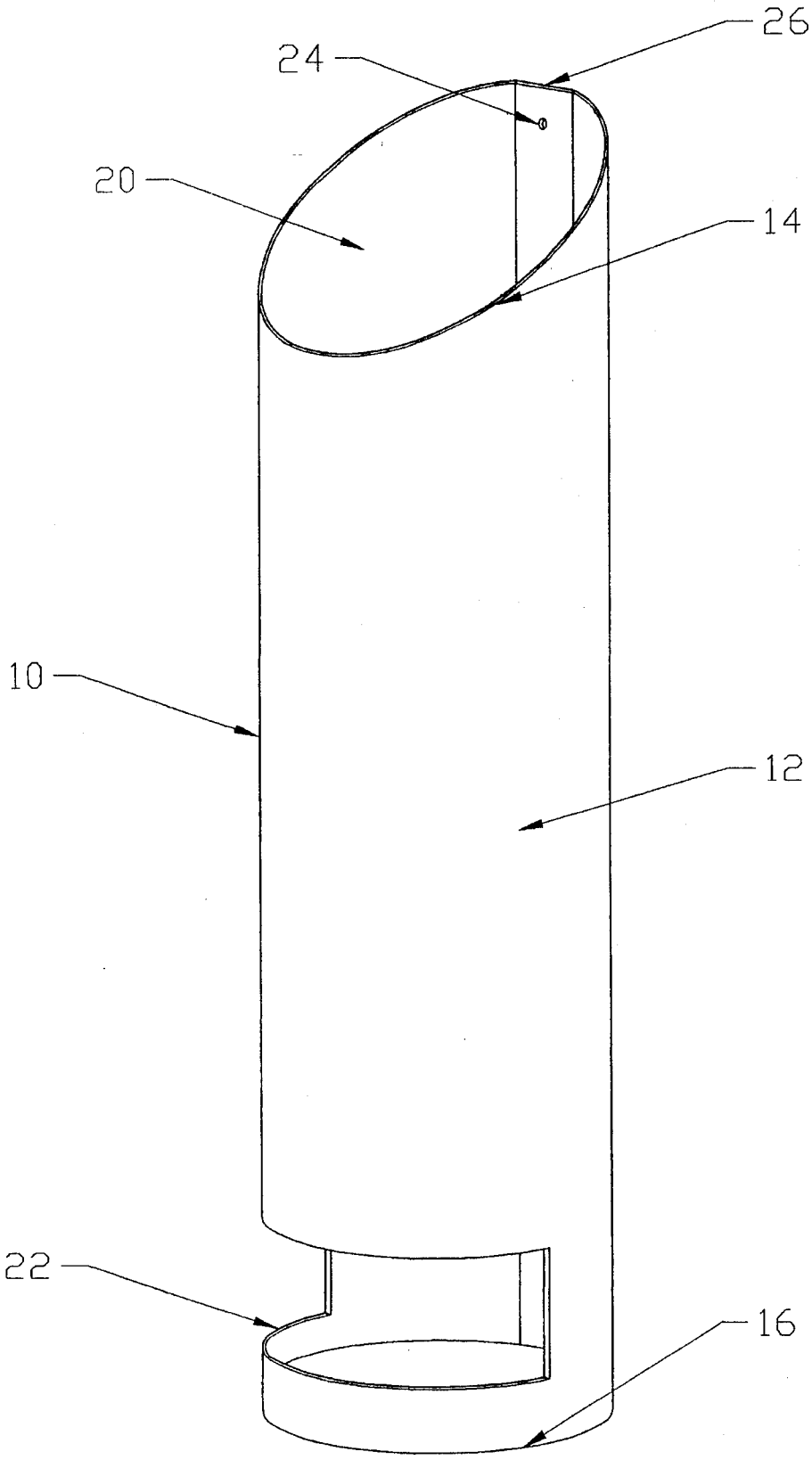
FIG. 2 is a perspective view of the second embodiment of the present invention.

In the above-described embodiment, the sleeve has a circular cross-section. However, the sleeve 12 can also be arranged so that there is a substantially flat surface 26 which is located on the encompassing side wall, as illustrated in FIG. 2, the second embodiment of the storage container 10 of the present invention.

As illustrated in this figure, the flat surface 26 is located on the back of the storage container and extends from the top portion 14 to the bottom portion 16. This flat surface should be approximately 1 inch in width. This configuration and arrangement will facilitate in the act of attaching the container to a particular surface. Accordingly, the attachment means would be located on the flat surface of the sleeve. In this figure, located in the top portion and on the flat surface of the encompassing side wall is the aperture 24. This aperture will enable a nail to be located therein. A second attachment means (not illustrated) may be located on the back and bottom portion of the flat surface of the encompassing side wall.

The cross-section of the curved portion would be somewhat circular, and would have a diameter of 3 inches.

In order to utilize the first or second embodiment of the container of the present invention, a user would merely fill the container 10 with the empty bags via the open top 20. When a single bag is desired, a user retrieves the bag via the slot 22. Due to the size and configuration of the slot, the bags can be extracted one at a time as well as being extracted with minimal difficulties.

To improve the aesthetic appearance of the container of the first and second embodiment, the encompassing side wall may be decorated.

While the invention has been particularly shown and described with reference to an embodiment thereof, it will be understood by those skilled in the art that various changes in form and detail may be made without departing from the spirit and scope of the invention.

I claim:

1. A container for holding used plastic grocery bags comprising:

a vertically extending sleeve;

said sleeve has a top portion, a front, a back, and a bottom portion;

said sleeve has a circular cross-section;

said circular cross-section includes a first diameter;

an open top is located at said top portion;

said open top is adapted to receive said used plastic grocery bags;

a bottom panel;

said bottom panel is integral to said bottom portion of said sleeve;

a horizontal slot is in said sleeve at said front of said bottom portion;

said slot has a height that is in a range of 1¼ to 1½ inches; and said slot has a length that is ½ said first diameter of said sleeve whereby, the above dimensions of the slot effect the release of one bag at a time.

2. A container as in claim 1 wherein said diameter is 3 inches.

3. A container as in claim 1 wherein said back of said sleeve includes an attachment means.

4. A container for holding used plastic grocery bags comprising:

a vertically extending sleeve;

said sleeve has a top portion, a front, a back, and a bottom portion;

said back of said sleeve includes a flat surface;

said flat surface has a width of 1 inch;

an open top is located at said top portion;

said open top is adapted to receive said used plastic grocery bags;

a bottom panel;

said bottom panel is integral to said bottom portion of said sleeve;

a horizontal slot is in said sleeve at said front of said bottom portion; and said slot has a height that is in a range of 1¼ to 1½ inches whereby, the above dimension of the slot effects the release of one bag at a time.

5. A container as in claim 1 wherein said flat surface of said back of said sleeve includes an attachment means.

* * * * *